United States Patent [19]

Nelson

[11] 4,222,223

[45] Sep. 16, 1980

[54] HEATHER YARN MADE FROM BULKED CONTINUOUS-FILAMENT YARNS

[75] Inventor: Thomas L. Nelson, Georgetown, Del.

[73] Assignee: E. I. Du Pont de Nemours and Company, Wilmington, Del.

[21] Appl. No.: 969,933

[22] Filed: Dec. 15, 1978

[51] Int. Cl.[3] ..... D02G 3/00; D02G 3/02; D02G 3/22

[52] U.S. Cl. ..... 57/246; 28/271; 57/245; 57/908

[58] Field of Search ..... 57/204, 205, 206, 207, 57/208, 243, 244, 245, 246, 289; 28/271

[56] References Cited

U.S. PATENT DOCUMENTS

| | | | |
|---|---|---|---|
| Re. 29,352 | 8/1977 | Newton | 57/246 |
| 3,026,697 | 3/1962 | Swaney . | |
| 3,309,855 | 3/1967 | Stoll et al. | 57/289 |
| 3,460,336 | 8/1969 | Collingwood et al. | 57/245 |
| 3,611,698 | 10/1971 | Horn et al. . | |
| 4,051,660 | 10/1977 | Griset | 57/205 |
| 4,059,873 | 11/1977 | Nelson | 28/271 |

*Primary Examiner*—Donald Watkins

[57] ABSTRACT

A coherent, bulked, continuous-filament, heather-dyeable yarn having a more natural, spun, wool-like appearance in carpets consists of lighter dyeing filaments which comprise 20–50% of the total yarn filaments and which are 15–45% longer than the darker dyeing filaments in the yarn. The yarn is produced by overfeeding the lighter dyeing filaments to a greater degree than the darker dyeing ones through a turbulent fluid-jet intermingling zone.

4 Claims, 1 Drawing Figure

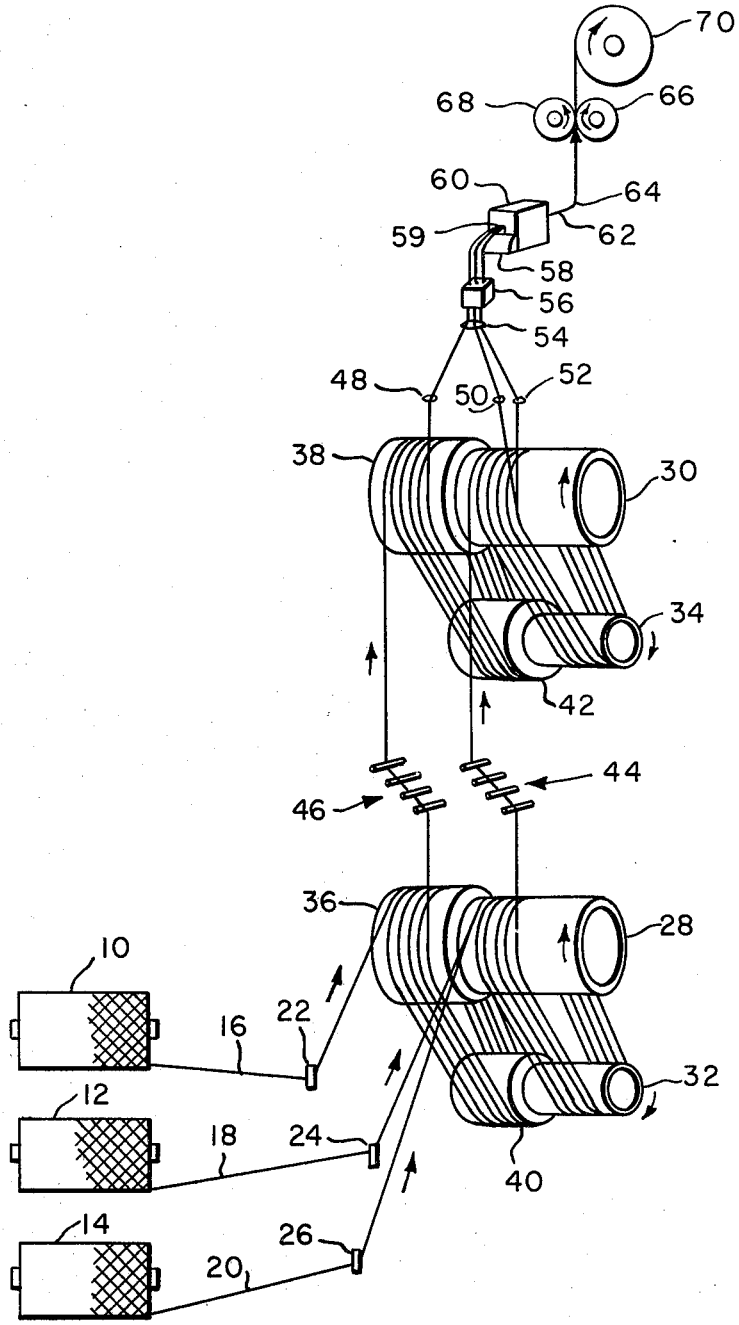
70
68
66
60
64
59
62
58
56
54
48
50
52
38
30
34
42
44
46
36
28
10
16
22
32
12
18
24
40
14
26
20

HEATHER YARN MADE FROM BULKED CONTINUOUS-FILAMENT YARNS

DESCRIPTION

1. Technical Field

This invention concerns a bulked continuous-filament combined yarn which can be differentially dyed to produce an improved, natural heather appearance and a process for making the yarn.

2. Background Art

Yarns of continuous filaments of one color or colorability can be combined with yarns of continuous filaments of another color or colorability in various ways to produce combined yarns which exhibit a wide variety of mixed color effects depending upon the manner in which the yarns are combined. On effect which can be obtained in this way is called a heather appearance, that is one having many flecks of various colors randomly distributed throughout the yarn. Such a heather appearance was originally obtained with yarns of mixed natural staple fibers such as wool. Many attempts have been made with varying degrees of success to achieve the natural heather appearance of staple yarns in continuous-filament yarns.

One known process for making a heavy denier, bulked, continuous-filament heather yarn is described and claimed in U.S. Pat. No. 4,059,873. Yarns made by that process are particularly suitable for use in upholstery fabrics and in carpets. That process reproducibly achieves a high degree of random filament intermingling which results in finished goods free of streaks and patterning, by overfeeding substantially entanglement-free, differentially dyeable, component yarns through a fluid-jet intermingling zone to make the heather-dyeable combined yarn. Whereas yarns produced by such a method have some of the heather characteristics of staple yarns, among other advantages, improvements continue to be sought in making a continuous-filament yarn which has a more natural heather appearance still closer to that of spun staple yarns of wool or of other natural spun fibers.

DISCLOSURE OF THE INVENTION

According to the present invention there is provided an improved, substantially twist-free, bulky, heather-dyeable, combined yarn comprised of at least two differentially-dyeable, types of randomly intermingled, continuous, crimped filaments wherein the improvement comprises having the filaments of one type, which type is lighter dyeing with respect to the other types, comprise from about 20% to about 50% of the total filaments in the combined yarn and have a length from about 15% to about 45% longer than the other filament types in the combined yarn, with the longer, lighter dyeing filaments forming numerous, crimped loops randomly distributed along the surface of the combined yarn and which loops are held in place by filament wraps and interentanglement in the combined yarn sufficient to provide a mean separation distance by the lateral pull-apart test of no more than about 1.5 inches (3.8 cm.), preferably from about 0.5 to 1.5 inches (1.3 to 3.8 cm.).

Also, according to this invention, there is provided an improved process for making a bulked, continuous-filament, heather-dyeable yarn which includes the steps of feeding from separate sources at least two differentially-dyeable types of bulked, continuous-filament component yarns, each component yarn consisting essentially of filaments of the same dyeable type and being substantially free of yarn twist and of filament entanglement, into a transverse-impingement fluidjet filament intermingling zone with at least 5% overfeed and collecting the resulting heather-dyeable combined yarn, wherein the improvement comprises differentially overfeeding a component yarn of one type to the zone at a percent overfeed which is from about 15% to about 45% above the percent overfeed of the other component yarns and randomly entangling the filaments in said zone within and among the component yarns to provide a coherent heather-dyeable combined yarn having a mean separation distance by the lateral pull-apart test of no more than about 1.5 inches (3.8 cm) and preferably from about 0.5 to about 1.5 inches (1.3 to 3.8 centimeters), with the further condition that the more highly overfed component yarn is comprised of filaments which are lighter dyeing than the filaments in the other component yarns and which comprise from about 20% to about 50% of the total filaments in the combined yarn.

Other embodiments of this invention will be apparent from the following description.

BRIEF DESCRIPTION OF THE DRAWING

The FIGURE is a schematic representation, in perspective view, of an apparatus suitable for practicing the process and for making the product of the present invention.

DETAILED DESCRIPTION OF THE INVENTION

The component feed yarns must be substantially free of true yarn twist. No twist is preferred but this does not exclude a small amount of twist which may occur incidentally in the handling of the yarns, such as by over-end take off of the yarn in a conventional manner from a stationary package, as from a creel. This substantial freedom from yarn twist is necessary to permit the necessary intermingling and interentangling among the filaments of the component yarns. Component feed yarns having no more than about one turn of true twist per 10 cm. are considered to be substantially free of twist. Once the combined yarn of the invention has been prepared, true twist can be introduced if desired for aesthetic reasons but it is not necessary for handling due to the coherency of the yarn without twist.

The yarn product of this invention derives its bulk primarily from the filament crimp and latent crimpability already present in the component yarns prior to their being combined. In other words, the filaments of the feed yarns are permanently crimped and retain their crimpy character upon removal from the feed yarn as well as from the combined yarn. For this reason, the loops formed from the longer filaments along the surface of the combined yarn are themselves crimped and irregular in nature rather than being smooth, arched and crunodal loops common to some known air-textured yarns. Accordingly, the bulkiness of the combined yarn is not primarily dependent upon the presence of such loops.

The yarn product of this invention is a combined yarn in the sense that it is comprised of individual component yarns of different filament types which are differentially dyeable with respect to one another. The different types of filaments are differentially dyeable with respect to one another meaning that using conventional cross-dyeing procedures they may be dyed to different colors or color shades (including remaining undyed) in a common dye bath.

The component yarns are selected such that the dyeability of filaments in the component yarn which is overfed to the higher degree in the process, resulting in the longer filaments in the product, is capable of being dyed to a lighter color, color shade or remain undyed with respect to other filaments in the combined yarn. Of course the same effect can be achieved by using component yarns which are already appropriately differentially colored, which option is also comprehended by the present invention but which will be considered for the purposes of this invention as being "differentially dyeable".

The filaments of the component yarns can be comprised of synthetic fiber-forming polymers including the polyamides, polyesters, polyethylenes, polypropylenes, polyacrylics and modacrylics and cellulose triacetate. Such polymers are thermoplastic in their crimping and crimp-setting behavior.

Differential dyeability can be obtained from different types of polymers such as with filaments of a polycarbonamide along with filaments of a polyester, such as poly(hexamethylene adipamide) with poly(ethylene terephthalate) or either of those with filaments of a polyolefin such as polyethylene.

For processability among other reasons, it is preferred that the differential dyeability result from the use of dyeable modifications of the same basic polymer, for example by altering acid dyeability in a polycarbonamide by changing the concentration of amine endgroups, and by introducing a comonomer containing cationically dyeable sulfonate groups, all of which are well-known in the art.

The component feed yarns for this invention must be substantially free of filament entanglement in order to obtain the desired degree of intermingling and interentanglement in the combined yarn. The freedom from entanglement can be expressed in terms of a coherency factor as described in U.S. Pat. No. 2,985,995 at Col. 4, lines 5–30. In this test, preferred component yarns for this invention are those which have a coherency factor upon being forwarded to the intermingling zone of no greater than about 5. Where the degree of filament entanglement in a feed yarn is too high for this invention, the entanglement can be removed to a sufficient degree by subjecting the crimped yarn to tension to pull out entanglement as described for example in U.S. Pat. No. 4,059,873. It is not necessary that this disentanglement step be coupled with the intermingling step but it can be conducted as a separate operation.

The component yarns are fed from separate sources, for example, from separate packages mounted on a creel; however, feeding from separate sources also includes the coupled process of feeding the yarns in a continuous matter from separate spinnerets or separate groups of spinneret orifices for the different components and forwarding them to the intermingling zone in a coupled operation involving spinning, molecularly orienting the filaments, crimping the filaments, disentangling the filaments, as necessary, and feeding them to the intermingling zone under the specified conditions of overfeed.

With respect to this invention, the term overfeeding means that the component yarns are fed to the intermingling zone at a linear rate which is greater than the linear rate of withdrawal of the combined yarn from the zone. Overfeed is calculated as a percentage based on the rate of withdrawal. The differential overfeed is expressed as the difference between the overfeed percentage for the more highly overfed component and for the other components, both percentages being calculated with respect to the withdrawal rate of the combined yarn.

The high level of filament interentanglement required in the combined product of this invention requires the use of a transverse-impingement fluid-jet to achieve the necessary degree of turbulence in the intermingling zone. "Transverse-impingement" means that the fluid impinges upon the component yarns in a direction substantially perpendicular to the yarn path through the zone. There must be sufficient filament turbulence created within and immediately following the jet, combined with the number and type of filaments and the percent overfeeds, to provide the specified degree of yarn coherency.

Conditions preferred because of the unique aesthetics achieved in combination with ease of processing include those wherein the longer, more highly overfed component provides from about 30% to about 40% of the filaments in the combined yarn and wherein the overfeed is about 20% to 30% with respect to the other filaments.

The invention requires at least two differentially dyeable components. There is little present incentive for economic and styling reasons to employ more than four. Most preferred, because of present popularity and accepted styling practice, is the use of three differentially dyeable components. In the case of polyamide yarns, commonly referred to as nylon, these three should consist of a deep and a light acid dyeable component along with a cationically dyeable component.

To achieve adequate bulk in the product of the invention, the filaments of the yarn components must have at least about 4 crimps per inch (158 per meter) measured as described herein, but in general at least 10 (395 per meter) is preferred. The filaments may be crimped by a number of well-known methods such as gear-crimping, stuffer-box crimping and hot fluid-jet crimping. Hot fluid-jet crimping is particularly preferred because of its unique random, curvilinear, 3-dimensional, non-helical crimp including randomly reversing S and Z filament twist. Numerous examples of the latter type are described in U.S. Pat. No. 3,186,155.

Whereas the process of this invention requires an overfeed for all component yarns of at least 5% in order to obtain sufficient interentanglement among all the components, it is preferred that this minimum overfeed be within the range of from about 10% to about 25% for optimum operability and product characteristics. Accordingly, 20% to 30% is the preferred range for differential overfeed.

At least 5% minimum overfeed is required in order to successfully obtain a differential overfeed of at least about 15%. As the minimum overfeed is increased, generally the operable differential overfeed also will be increased.

A differential overfeed of at least about 15% is required to obtain the unique appearance of the product. At a differential overfeed of greater than about 45%, problems in handling of the yarn increase significantly and the dyed yarn begins to assume a frosty appearance.

Similarly, if the number of differentially overfed, lighter dyeing filaments is decreased below about 20%, the natural effect is of marginal significance. The most preferred combination of distinctive product appearance and manageable process operability during manufacture and use is realized when the filaments of the more highly overfed component constitute from about 25% to about 40% of the total filaments in the combined yarn at a differential overfeed of 20% to 30%.

Because of its simplicity and effectiveness, a preferred fluid-jet configuration for this invention is one having a single fluid stream transversely impinging on the yarn in the yarn passageway. As is well known in the art, overfeeding of yarn requires a forwarding action from the jet from fluid preferentially exiting the jet in the yarn forwarding direction. For this invention, this forwarding action is preferably obtained by the use of a yarn gate which is positioned to partially cover one side of the entrance to the yarn passageway within the jet apparatus. The gate should be positioned to cover eccentrically from about 30% to 80% of the opening, and preferably 45% to 70%. The preferred intermingling fluid is pressurized air at about ambient temperature. Pressures generally in the range of from about 7 to 14 kilograms per square centimeter are sufficient for the preferred yarn deniers of this invention.

To increase the efficiency of intermingling, the feed yarn may be wetted with water as is known, for example by sprays, at any convenient stage prior to entering the intermingling zone. Other liquids and yarn finishes may be used which increase this efficiency.

In order to limit the influence of fluid exiting the jet upon the yarn both entering and being withdrawn, from the intermingling zone, the yarns preferably enter and exit the jet at essentially right angles to the yarn path.

As is known in the art, the overfeed condition in the intermingling zone can be provided by operating a windup roll, or let-down roll, following the intermingling zone at a slower surface speed than that of rolls feeding yarns into the zone. However, for this invention since the component yarns are differentially overfed, arrangements must be made for feeding one yarn component at a faster rate than the others. This can be provided either by the use of separate feed rolls operating independently of one another or by the use of stepped feed rolls operated for all yarns at the same rpm but where the differential speed is achieved by having a roll portion forwarding the more highly overfed component being of greater diameter than that portion of the rolls forwarding the other components. The latter is a most convenient means for operating consistently once the desired differential has been established.

Because the loopy surface of the yarn of this invention is sensitive to hang ups on worn guide surfaces and to yarn-on-yarn rubbing, it has been found that creel delivery and tufting performance of the yarn from supply packages is improved with the use of precision wound as opposed to random wind packages.

The product of this invention is of particular interest with respect to upholstery and carpet end uses. Such uses commonly involve yarn deniers from about 500 to 5,000 or more for the combined yarn of this invention and which contain filaments having a denier per filament preferably within the range of about 5 to 25. The denier per filament within the component yarns as well as between component yarns may be the same or different as desired depending upon the yarn aesthetics. The filaments may be of any desired cross-section including round, non-round, and hollow. Of particular interest to the carpet trade are those filaments having a trilobal cross-section and also those having non-round cross-sections with multiple continuous voids as are known and commercially available in the trade.

Another measure of yarn bulk which can be used as a measure of adequate filament crimp in the component yarns, as well as in the combined yarns, is the bundle crimp elongation (BCE) test as described herein. Suitable component yarns are those having a BCE of at least about 50%. The combined yarn preferably has a BCE of at least about 25%. Generally the greater the BCE the greater the size and number of crimps in the filaments.

For this invention, filaments having a crosssection which gives reflected, highly lustrous highlights, called glitter, should be avoided where the most natural, wool-like appearance is desired. Accordingly, it is preferred that the filaments, particularly the longer filaments in the more highly overfed component be delustered, i.e., contain a delustering agent. Suitably delustered filaments are those commercially classified as being "semi-dull" or "dull", for example those containing at least about 0.10% by weight of a delustering pigment such as titanium dioxide. As known in the art, luster may also be reduced by the proper selection of filament cross-section, by increasing filament crimp and by the use of other delustering agents including numerous discontinuous microscopic voids as well as particulate matter and surface roughening agents.

Various apparatuses can be used to operate the process of this invention. The choice is partially dependent upon the source and nature of the feed yarns, for example, a coupled continuous operation vs. split process, and whether or not filament disentanglement is required. The apparatus schematically illustrated in the Figure is a preferred arrangement for use with crimped feed yarns in packaged form or fed directly in a coupled operation, which yarns require tensioning to remove filament entanglement. In reference to the Figure, there are shown three stationary yarn packages, for example, bobbins of yarn, 10, 12, 14 of crimped, continuous-filament component yarns mounted in a fixed position as on a creel (not shown) from which are withdrawn in a continuous manner 3 component yarns 16, 18 and 20. Of course, in a coupled operation the creel and packages would be eliminated. Each of the component yarns consists essentially of filaments which are differentially dyeable with respect to the filaments in each of the other component yarns. In addition, the filaments of yarn 16 are lighter dyeing with respect to the filaments in yarns 18 and 20. The yarns pass through yarn guides 22, 24 and 26 to a pair of driven, step rolls 28, 30 and their associated stepped separator rolls 32, 34 respectively. Roll 28 and its separator roll 32 act as yarn snubbing rolls and roll 30 and its associated separator roll 34 apply tension to the yarns and act as feed rolls to the next stage of the process.

Each of rolls 28, 30, 32 and 34 have a stepped end-portion 36, 38, 40 and 42 respectively which contacts only yarn 16 and which has a greater diameter than the remaining portion of the roll surface for contacting yarns 18 and 20. Since these stepped end-portions rotate at the same rate as the smaller portions of these rolls, they provide a higher linear surface speed and accordingly a higher speed to yarn 16 relative to yarns 18, 20. The circumferences of the stepped portions 36, 38, 40 and 42 of the rolls are each proportionally greater than that of the respective roll portions in contact with yarns 18 and 20 to provide the desired differential overfeed for yarn 16. In this way, a predetermined differential overfeed can be accurately maintained and there is no need for a separate set of driven rolls for the faster yarn.

Yarn 16 is supplied to stepped portion 36 of roll 28 (and of the succeeding rolls) and yarns 18, 20 are supplied in a side-by-side relationship to the smaller portion of roll 28 and of the successive rolls. The yarns pass around each roll and its associated separator roll a sufficient number of times to prevent slippage of the yarn on the roll surface in the conventional manner. Roll 30 is driven at a slightly faster surface speed (higher rpm if of the same diameter) than that of roll 28 in order to subject the yarns to tension between the rolls. This tension is not only sufficient to straighten out the crimps in the filaments of the yarns, but also must be additionally greater to remove filament entanglement within each yarn. The applied tension must not be so great as to cause drawing of the filaments which would permanently remove or reduce crimp. To increase the effectiveness of the disentangling process, snubbing devices 44 and 46, each consisting of a series of stationary snubbing pins, are positioned between rolls 28 and 30. The yarns pass over and under alternate pins in a conventional manner to create tension and spread out the filaments in each yarn to facilitate disentanglement.

From feed roll 30, yarns 16, 18 and 20, now substantially free of filament entanglement, pass through change of direction yarn guides 48, 50 and 52, respectively, and then through convergence guide 54 and next through a water applicator 56 wherein water is applied to each yarn in a conventional manner, such as by a spray, individually to assist subsequent intermingling.

The wetted yarns next enter a transverse impingement fluid-jet body 60 by riding over yarn gate 58 which has a smooth rounded yarn contacting surface which is positioned to partially cover the entrance 59 to the yarn passageway in fluid-jet body 60. Within the jet body 60, the yarn passageway is perpendicularly intersected by a single fluid passageway (neither passageway shown) supplying pressurized fluid with sufficient force to create a turbulent zone within and immediately external to the passageway exit to interentangle the filaments of yarns 16, 18, 20 into the combined yarn 62 which exits the yarn passageway from the opposite side of jet body 60. Such jets are well-known in the art as for example as described in detail in FIG. 2 of U.S. Pat. No. 4,059,873.

The eccentric restriction of the entrance 59 to the yarn passageway in jet body 60 by gate 58 among other things causes the jet fluid primarily to exit the yarn passageway concurrently with the combined yarn 62 through the opposite side of the jet body 60. This concurrent flow of fluid with yarn movement through the passageway serves to forward the yarns from feed roll 30, and from stepped portion 38, irrespective of the different yarn speeds. Combined yarn 62 is removed from the yarn passageway in jet body 60 at an angle 64 substantially 90° to that of the yarn passageway to separate the yarn from the exiting fluid, as known in the art. Combined yarn 62 is led away from the jet by coner rolls 66, 68 which forward yarn 62 to yarn windup device 70 at a reduced speed (at least 5% less) with respect to the slower yarns 18, 20 entering jet body 60. This speed differential permits all the yarns to become substantially free from tension upon passing through the intermingling zone as is necessary to obtain the required degree of filament intermingling and entanglement within and among the component yarns 16, 18 and 20 in combined yarn 64.

TEST METHODS

Filament Length Differential

Each differentially-dyeable type of filament in a sample of the heather-dyeable combined yarn is dyed to a distinctive color or shade using an appropriate conventional cross-dyeing procedure with at least one dye for each type. Alternatively, only the lighter dyeable filaments may be left undyed. A 10–12 inch (25.4–30.5 cm) length of the cross-dyed yarn is hung vertically and a simple overhand knot tied tightly near the mid-point of the sample. A 0.025 gram per denier weight (100 gram weight for a 4,000 denier yarn) is attached to the free end of the sample. The yarn is carefully cut into two pieces at a point 2 inches (5.08 cm) below the knot. Filament entanglement in the yarn below the knot is carefully combed out using a fine wire brush such as that used to brush or raise the nap on suede leather. A strip of double-adhesive transparent tape which exceeds two inches (5.08 cm) in length in one direction is placed on black matte paper. The combed out filaments are carefully cut free immediately below the knot. Using tweezers, five filaments from each component color are placed in parallel array on the exposed surface of the double adhesive tape. The mounted filaments are then covered by a strip of single-adhesive transparent tape to secure them firmly in place. The length of each filament is measured with a map distance measuring instrument such as one manufactured by Keuffel and Esser No. 62 0300. The filament lengths are recorded in centimeters ±0.01 cm. The steps are repeated until 50 individual filament lengths for each color have been recorded. The average of the 50 measurements is calculated for each filament type. The averages for the non-light dyeing filaments are also averaged with each other. The percent filament length differential is then calculated by subtracting the combined average length for all the deeper dyed filaments from the average length for the lighter dyed filaments. This difference is then divided by the combined average of all the deeper dyed filaments and multiplied by 100 to obtain the percent differential.

Pull-Apart Test For Lateral Coherency

This test directly measures the lateral coherency of the yarn. Tow hooks are placed in about the center of the yarn bundle to separate it into two groups of filaments. The hooks are pulled apart at 12.7 cm/min at 90° to the bundle axis by a machine which measures the resistance to separation, such as an Instron machine. The yarn is pulled apart by the hooks until the force exerted on the total yarn bundle is as follows, at which point the machine is stopped:

| Yarn Denier | Pull-Apart Force |
|---|---|
| 140–574 | 50 grams |
| 575–1299 | 200 grams |
| 1300–5000 or more | 454 grams |

The distance between the two hooks is measured. The average of ten determinations is taken as the lateral coherency. The test yarn lengths sould be at least 10 to 15 cm. long, taken randomly.

Bundle Crimp Elongation (BCE)

Bundle crimp elongation is determined on yarn which has been treated as follows: A 100–105 cm. length of yarn is put into a water bath and boiled at about 100° C. for three minutes. The yarn is rinsed in cold water and dried at 100°–110° C. for 1 hour, all under a relaxed condition. The yarn is conditioned at 72% relative humidity for 2 hours. A 55 cm. length of yarn is fastened to a clamp on the upper end of a 150 cm. vertical board. Fifty centimeters below the upper clamp, a second weighted yarn clamp is hooked to the board, the total weight of the second clamp assembly being 0.08 to 0.12 gpd.

The yarn is attached to the second clamp, which is then unhooked and lowered gently and allowed to hang at the end of the yarn for three minutes. At this time, the extended length is measured. The percent BCE is calculated by multiplying the increase in length by two. BCE is the average of three measurements.

Crimps Per Inch (CPI)

The yarn is boiled and conditioned as described above. A section of yarn in a relaxed condition is cut to two inches (5.08 cm.). A single filament is taken from this yarn section and clamped at the ends between two clamps two inches apart. The clamps are mounted over a piece of black cloth to facilitate counting the crimps. Only significant crimps readily visible at low magnification are counted. A crimp is defined as one complete crimp cycle or sine wave. The crimps/inch are calculated by dividing the number of crimps for a single filament by two. Because of the random nature of the three-dimensional crimp, some judgement must be exercised in determining the significant crimp. Look for abrupt changes in the direction of the filament. CPI is the average of three measurements.

Coherency Factor

A sample of yarn is clamped in a vertical position under the tension provided by a weight in grams which is 0.20 times the yarn denier (but not greater than 100 grams). A weighted hook, having a total weight in grams numerically equal to the mean denier per filament of the yarn (but weighing not more than 10 grams), is inserted through the yarn bundle and lowered at a rate of 1 to 2 cm/second until the weight of the hook is supported by the yarn. The distance which the hook has travelled through the yarn characterizes the extent of filament entanglement. The result is expressed as a "coherency factor" which is defined as 100 divided by the above distance in centimeters. Since filament intermingling is random a large number of samples should be tested to define a representative value for the whole yarn.

EXAMPLES

Heather-dyeable yarns as summarized in Table I are prepared by combining differentially-dyeable, bulked, continuous-filament yarns with one another using a fluid-jet and differential overfeed under operating conditions ae summarized in Table II.

Each component feed yarn includes 80 filaments of poly(hexamethylene adipamide) which have a denier per filament of about 15 and a tetralobal cross-section with 4 continuous voids to provide a total void of about 13% as claimed in U.S. Pat. No. 3,745,061. The filaments are hot fluid jet-crimped as described in U.S. Pat. No. 3,186,155 to impart a random, 3-dimensional, non-helical curvilinear crimp with random S and Z filament twist. The filaments have a latent enhanced crimp upon relaxed boil-off. The filaments have at least 8 cpi (315/meter) and a BCE of about 55%. The yarns are free of true yarn twist but contain some filament entanglement as a result of the crimping treatment. Prior to their being combined, the filament entanglement is substantially removed by subjecting the yarn to a tension of about 1.0 gram per denier, either in a separate step or as a coupled step, prior to being combined with the fluid jet. As forwarded to the jet, the component feed yarns have a coherency factor of less than about 5%.

The filaments contain about 0.15% by weight of titanium dioxide pigment to provide a semi-dull polymer luster.

Three types of component yarns are used. One is dyeable with cationic dyes as a result of the polymer containing about 1.70 mole percent of an aromatic dicarboxylic acid monomer containing a sodium sulfonate group. Another has a light acid-dye capability from containing a low number of free amine end-groups of about 30 equivalents per million grams of polymer. The third type has a deep acid-dye capability from having a high concentration of amine end-groups of about 86 equivalents per million grams of polymer.

The deep acid-dyeing yarn in addition to the regular polyamide filaments contains 3 co-bulked sheathcore antistatic filaments of the type claimed in U.S. Pat. No. 3,803,453 which three filaments have a total denier of about 20 giving the component yarn a total denier of about 1245. The other yarns each have a total denier of about 1225.

In each Example the fluid-jet which provides the filament intermingling and entangling consists of a yarn passageway intersected perpendicularly by a smaller single fluid passageway. The entrance to the yarn passageway is partially blocked by a yarn gate (~65%) as shown and described in the Figure. The fluid passageway is supplied with air at ambient temperature (about 25° C.) under a pressure of 150 psig (10.5 kilograms per square centimeter). Except as otherwise, specified, the yarns enter and exit the jet substantially at right angles in the manner shown in the Figure.

TABLE I

| Example Number | 1 | 2* | 3* | 4 | 5 | 6 | 7* | 8 |
|---|---|---|---|---|---|---|---|---|
| Feed Yarn Details | | | | | | | | |
| "UP" End(s) | Light Cat./ | Cat. Light/ | Deep Cat./ | Light Cat./ | Light Deep | Light Cat./ | Deep Light | Light Cat./ |
| "Down" End(s) | Deep | Deep | Light | Deep | | Deep | | Deep |
| "Up"/"Down" Filament Ratio | ½ | ½ | ½ | ½1/1 | 2/2 | ½ | ½ | |
| Differential Overfeed, Δ% | 23 | 23 | 23 | 45 | 25 | 25 | 25.5 | 25.5 |
| Combined Yarn Properties | | | | | | | | |
| Pull-Apart, in. (cm) | 0.69 | 0.75 | 0.76 | 0.45 | 0.75 | 0.65 | ~0.76 | 0.79** |

TABLE I-continued

| Example Number | 1 | 2* | 3* | 4 | 5 | 6 | 7* | 8 |
|---|---|---|---|---|---|---|---|---|
| | (1.75) | (1.90) | (1.93) | (1.14) | (1.90) | (1.65) | (1.93) | (2.01) |
| Filament Length Diff., | ~26 | — | — | 45 | — | — | —23.6 | |
| B C E, % | ~30 | ~30 | ~30 | ~30 | ~30 | ~30 | ~30 | ~30 |
| Denier | 3850 | 3850 | 3850 | 4200 | 2650 | 5300 | 4000 | 4000 |

*Not Examples of the invention
**Lot average for 36 tubes; high tube 1.01 in (2.57 cm.), low tube 0.62 in. (1.57 cm.).

TABLE II

| Example Number | 1 | 2 | 3 | 4 | 5 | 6 | 7 | 8 |
|---|---|---|---|---|---|---|---|---|
| Machine Settings | | | | | | | | |
| Roll Speed, ypm | 689 | 689 | 689 | 800 | 855.6 | 855.6 | 855.6 | 855.6 |
| (meters/min) | (630) | (630) | (630) | (731) | (782) | (782) | (782) | (782) |
| Overfeed, % | 38 | 38 | 38 | 60 | 37 | 37 | 40.5 | 40.5 |
| Wetted | No | No | No | No | Yes | Yes | Yes | Yes |
| "Down" End(s) | | | | | | | | |
| Roll Speed, ypm | 575 | 575 | 575 | 575 | 700.4 | 700.4 | 700.4 | 700.4 |
| (meters/min) | (525) | (525) | (525) | (525) | (640) | (640) | (640) | (640) |
| Overfeed, % | 15 | 15 | 15 | 15 | 12 | 12 | 15 | 15 |
| Wetted | Yes | Yes | Yes | Yes | Yes | Yes | Yes | Yes |
| Take-up Roll,ypm | 500 | 500 | 500 | 500 | 625 | 625 | 609 | 609 |
| (meters/min) | (457) | (457) | (457) | (457) | (571) | (571) | (556) | (556) |
| Water Appliance | | | | | | | | |
| Type | 1-slot | 1-slot | 1-slot | 1-slot | 3-slot | 3-slot | 3-slot | 3-slot |
| Flow Rate, gph | >1 | >1 | >1 | 1.0 | 1.0 | 1.0 | 1.0 | 1.0 |
| Fluid Jet | | | | | | | | |
| Type** | A | A | A | B | B | C | B | B |
| Wind Tension, gm | 300 | 300 | 300 | 400–250 | 250 | 250 | 300–200 | 300–200 |

*Gallons per hour (3.79 liters/hr.)
**A - Yarn passage, length/dia. = 25.4 mm/3.75 mm
B - Yarn passage, length/dia. = 19.05 mm/4.04 mm
C - Yarn passage, length/dia. = 25.4 mm/5.18 mm
**Fluid Passage cross-section and location between yarn entrance and exit
A - rectangular, 2.36×3.175 mm.; centered.
B - round, 3.175 mm dia.; 6.35 mm. from gate.
C - rectangular, 2.71×4.65 mm.; centered.

EXAMPLES 1–3

Example 1, compared with Examples 2 and 3 (not of the invention), demonstrates the necessity of differentially overfeeding the lightest dyeing component in order to obtain the distinctive natural appearance provided by this invention.

These three examples are run under the same conditions using one end each of the above 3 component yarns except for changing the more highly overfed component. The more highly overfed component for Example 1 is the light acid-dyeable one. For Example 2 it is the cationic dyeable one and for Example 3 it is the deep acid-dyeable one. In each case the other two component yarns are overfed to a lesser degree. Therefore, about 33⅓% of the total filaments have the higher overfeed.

The apparatus consists of separate, independently controlled yarn forwarding rolls to provide the differential overfeed. The component feed yarns were processed to remove filament entanglement in a separate step by tensioning and rewinding prior to their being combined.

The water applicator has a slot through which the yarns run where water is metered onto the moving yarns through an orifice in the side of the slot.

The two slower yarns are fed to the jet entrance in the conventional manner over the yarn gate while the faster yarn is supplied to the jet at an angle of about 45° to the center line of the jet passageway. This angle is selected to minimize thread line interaction with the counter-current air flow exhausting from the jet entrance.

The differential overfeed increases the jet entangling efficiency due to the wide range of filament tensions and freedom of movement in the passageway which improves bundle splay of the filaments and interfilament migrations needed for the high combined yarn coherency.

A banded level loop carpet is tufted with a band of each yarn. The carpet construction is ⅛ inch (3.17 mm) gauge, ¼ inch (6.35 mm) pile height and 22 ounces (62.4 g) per square yard (0.836 $m^2$). The banded carpet is cross-dyed to dye each yarn type but with the light acid dyeing component having the lightest color as described in Example 8.

The band of the yarn of Example 1 has an increased amount of the lighter dyed filaments apparent on the yarn surface and shows a distinctive and attractive wool-like appearance, distinctively different from Examples 2 and 3 and from heather yarns prepared without the differential overfeed as described in U.S. Pat. No. 4,059,873. The bands tufted from yarns of Examples 2 and 3, having the cationic or deep acid dyeing component as the higher overfed component, have a non-distinctive appearance with respect to yarns made without the differential overfeed.

Floor tests of carpet of yarn of Example 1 in a busy hallway and with commercial cleaning cycles is rated as satisfactory in all floor performance parameters.

The combined yarn prior to dyeing consists of a highly entangled core containing numerous surface filament loops and filament wrap-arounds. The loop diameters roughly vary from about 1/16 inch to ¼ inch (0.16–0.64 cm). Skeins of the dyed yarn show reduced surface loopiness (compared to pre-dyed) and the yarn has a dry, crisp hand. In spite of these surface loops, the carpet tufting process shows no unusual problems.

Under substantially the same conditions as for Example 1, yarns are prepared using 5, 10 and 15% differential overfeeds for the light acid dyeing component. The items with the 5 and 10% overfeed upon the same type of dyeing show substantially no distinctive difference in appearance, except as a slightly bolder heather, compared to a control item with no differential overfeed. With a differential overfeed of about 15% the natural wool-like appearance distinctive of this invention becomes apparent.

EXAMPLE 4

Example 4 demonstrates the desired effect obtained at a higher differential overfeed than that used in Example 1. The conditions are the same as for Example 1 except that the overfeed percentage for the light-acid dyeing component exceeds that of the other components by 45 percentage points. Combined yarn properties and processing conditions are shown respectively in Tables I and II.

The jet consumes air under the conditions shown at the rate of 30 standard cubic feet per minute (848 l./min).

A tufted level loop pile carpet is prepared from the yarn and cross-dyed as described in Example 8.

The dyed carpet has a natural wool-like appearance with a pronounced visual softening of the heather from the light-dyed surface filaments.

EXAMPLES 5-6

Examples 5 and 6 demonstrate the distinctive natural appearance obtained for yarns of this invention having about 50% of the filaments in the combined yarn being more highly overfed and of the light-dyeing type.

The yarns are prepared on an apparatus of the type substantially as shown in the Figure. The driven rolls have an outside diameter of 4 inches (10.16 cm.) at the larger stepped end and a diameter of 3.28 inches (8.33 cm.) at the smaller end thus providing a differential overfeed of about 25%. The yarns of Example 5 contain only 2 types of differentially dyeable filaments, the light acid and deep-acid dye types. The yarn of Example 6 contains two ends of the light acid dyeing yarn combined with one end each of the cationic dyeable yarn and the deep acid dyeable yarn. Thus the lighter dyeing filaments comprise about 50% of the filaments in the combined yarn in each case.

Carpets of each are prepared and dyed as in Example 8 except for no cationic dyes for Example 5. The dyed carpets have a distinctive natural spunlike appearance.

EXAMPLE 7

Example 7, not of the invention, demonstrates in a two color yarn again the necessity of having the lighter dyeing component as the higher overfed end in order to obtain the distinctive, natural yarn appearance of this invention. In this case, the deep acid dyeing end is more highly overfed in combination with two ends of the lighter dyeing component. The apparatus is the same as that used for Example 5.

Looped pile carpet of the yarn when dyed as in Example 8 is more typical of prior known heather yarns without a distinctive soft, natural look as seen in Example 1 or 5.

EXAMPLE 8

Example 8 provides substantially the same preferred product and dyed appearance as in Example 1 but prepared under preferred in-line process conditions using an apparatus of the type represented by the Figure; thus demonstrating reproducibility of results.

Tufted, level loop pile carpet of the combined yarn is cross-dyed using conventional beckdyeing procedures and conditions for 66-nylon carpets with the following dyes and amounts: 0.03% (on weight of fiber) of an orange cationic dye (Sevron® Orange CL); 0.015% blue cationic dye (Sevron® Blue GCN); 0.24% yellow acid dye (Nylanthrene® F Yellow FLW); 0.09% blue acid dye (Merpacyl® Blue SW); and 0.105% red acid dye (Merpacyl® Red G). After dyeing, the carpet backing is latexed conventionally.

The dyes provide a carpet with an "earth tone" heather with the cationic dyed filaments having a grey tone with yellow overtones. The dyed light acid-dyeable filaments have a noticeably lighter grey tone as compared to a deeper grey tone for the dyed deep acid-dyeable filaments, and as compared to the cationic dyed filaments.

The dyed carpet has a distinctive, pleasing, natural, spun-like look much like that of a similarly dyed spun-wool carpet.

I claim:

1. An improved, substantially twist-free, bulky, heather-dyeable, combined yarn comprises of at least two differentially dyeable types of randomly intermingled, continuous, crimped filaments wherein the improvement comprises having the filaments of one type, which type is lighter dyeing with respect to the other types, comprise from about 20% to about 50% of the total filaments in the combined yarn and have a length from about 15% to about 45% longer than the other filament types in the combined yarn, with the longer, lighter dyeing filaments forming numerous, crimped loops randomly distributed along the surface of the combined yarn and which loops are held in place by filament wraps and interentanglement in the combined yarn sufficient to provide a mean separation distance by the lateral pull-apart test of no more than about 1.5 inches.

2. A yarn of claim 1 wherein the lighter dyeing filaments comprise from about 25% to about 40% of the total combined yarn filaments and are about 20% to about 30% longer than the other filaments.

3. A yarn of claims 1 or 2 having a BCE of at least 25% and wherein substantially all the filaments contain at least about 0.10% titanium dioxide as a delusterant.

4. A yarn of claims 1 or 2 wherein the filament crimp is a random, three-dimensional, non-helical curvilinear crimp with random alternating S and Z filament twist and the yarn consists essentially of three, differentially-dyeable types of filaments comprising a light acid-dyeable type, as the lighter dyeing filaments, a deeply acid-dyeable type and a cationic dyeable type.

* * * * *

UNITED STATES PATENT OFFICE

CERTIFICATE OF CORRECTION

PATENT NO. : 4,222,223

DATED : September 16, 1980

INVENTOR(S) : Thomas Larson Nelson

It is certified that error appears in the above-identified patent and that said Letters Patent are hereby corrected as shown below:

Col. 1, line 17, "On" should be -- One --.

Col. 2, line 4, "fluidjet" should be -- fluid-jet --.

Col. 2, line 31, "DESCRIPTION" should be -- DISCLOSURE --.

Col. 6, line 11, "crosssection" should be -- cross-section --.

Col. 8, line 67, "sould" should be -- should --.

Col. 10, line 26, delete the " % " sign.

Table I, col. 4 " ½1/1" should be -- ½ --.

Table I, col. 5 " 2/2 " should be -- 1/1 --.

Table I, col. 6 " ½ " should be -- 2/2 --.

Table I, col. 8, under "Deep" insert -- ½ --.

Table II, under "Machine Settings" insert -- Up End(s) --.

Table II, line 12, "Appliance" should be -- Applicator --.

Col. 14, line 32 "comprises" should be -- comprised --.

Signed and Sealed this

*Seventeenth* Day of *November 1981*

[SEAL]

*Attest:*

GERALD J. MOSSINGHOFF

*Attesting Officer*

*Commissioner of Patents and Trademarks*